US008689912B2

(12) United States Patent
Belnap et al.

(10) Patent No.: US 8,689,912 B2
(45) Date of Patent: Apr. 8, 2014

(54) POLYCRYSTALLINE DIAMOND CONSTRUCTIONS HAVING OPTIMIZED MATERIAL COMPOSITION

(75) Inventors: J. Daniel Belnap, Lindon, UT (US); Georgiy Voronin, Orem, UT (US); Feng Yu, Pleasant Grove, UT (US); Peter Cariveau, Draper, UT (US)

(73) Assignee: Smith International, Inc., Houston, TX (US)

( * ) Notice: Subject to any disclaimer, the term of this patent is extended or adjusted under 35 U.S.C. 154(b) by 474 days.

(21) Appl. No.: 12/954,403

(22) Filed: Nov. 24, 2010

(65) Prior Publication Data

US 2012/0125696 A1 May 24, 2012

(51) Int. Cl.
*E21B 10/36* (2006.01)

(52) U.S. Cl.
USPC ..... 175/434; 175/433

(58) Field of Classification Search
USPC ..... 175/434, 433, 405.1, 420.2; 51/309, 51/306, 295, 297
See application file for complete search history.

(56) References Cited

U.S. PATENT DOCUMENTS 4,604,106 A 8/1986 Hall
2011/0031032 A1 * 2/2011 Mourik et al. ..... 175/428

FOREIGN PATENT DOCUMENTS

EP 1760165 3/2007
WO 2011017673 2/2011

OTHER PUBLICATIONS

International Report on Patentability, 11 pages, date of issuance, May 28, 2013.

* cited by examiner

*Primary Examiner* — Cathleen Hutchins
(74) *Attorney, Agent, or Firm* — Novak Druce Connolly Bove + Quigg LLP

(57) ABSTRACT

Diamond bonded constructions include a diamond body comprising intercrystalline bonded diamond and interstitial regions. The body has a working surface and an interface surface, and may be joined to a metallic substrate. The body has a gradient diamond volume content greater about 1.5 percent, wherein the diamond content at the interface surface is less than 94 percent, and increases moving toward the working surface. The body may include a region that is substantially free of a catalyst material otherwise disposed within the body and present in a gradient amount. An additional material may be included within the body and be present in a changing amount. The body may be formed by high-pressure HPHT processing, e.g., from 6,200 MPa to 10,000 MPa, to produce a sintered body having a characteristic diamond volume fraction v. average grain size relationship distinguishable from that of diamond bonded constructions form by conventional-pressure HPHT processing.

41 Claims, 6 Drawing Sheets

FIG. 5
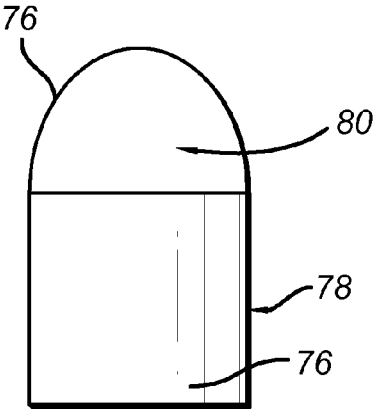
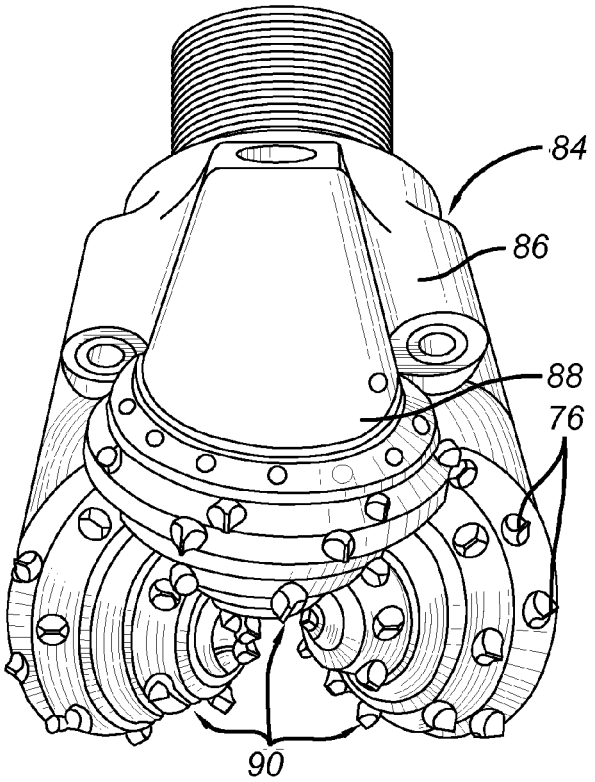
FIG. 6
FIG. 7
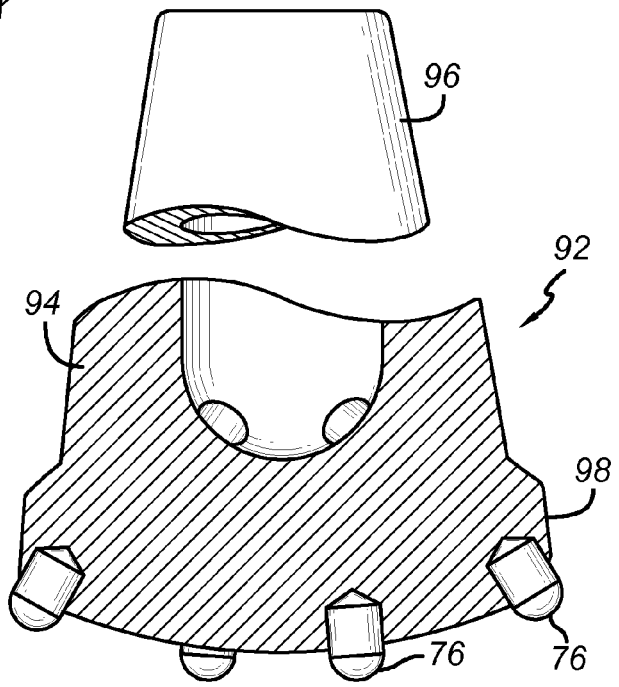

POLYCRYSTALLINE DIAMOND CONSTRUCTIONS HAVING OPTIMIZED MATERIAL COMPOSITION

BACKGROUND

1. Field of the Invention

This invention relates to polycrystalline diamond constructions used for subterranean drilling applications and, more particularly, to polycrystalline diamond constructions engineered having a controlled gradient content of catalyst/binder material for purposes of providing optimized properties of abrasion resistance and thermal stability, while maintaining a desired degree of fracture toughness, impact resistance, and resistance to delamination when compared to conventional polycrystalline diamond constructions.

2. Background of the Invention

Polycrystalline diamond (PCD) materials known in the art are formed from diamond grains or crystals and a catalyst material, and are synthesized by high pressure-high temperature (HP/HT) processes. Such PCD materials are known for having a high degree of wear resistance, making them a popular material choice for use in such industrial applications as cutting tools for machining, and wear and/or cutting elements in subterranean mining and drilling, where such high levels of wear or abrasion resistance are desired. In such applications, conventional PCD materials may be provided in the form of a surface layer or an entire material body to impart desired levels of wear and abrasion resistance thereto.

Traditionally, PCD cutting elements used in such applications are formed by applying one or more layers of such PCD material to, or forming a body of such PCD material, for attachment with a suitable substrate material. Example PCD cutting elements known in the art may include a substrate, a PCD surface layer or body, and optionally one or more transition or intermediate layers to improve the bonding between and/or provide transition properties between the PCD surface layer or body and the underlying substrate support layer. Substrates used in such cutting element applications include carbides such as cemented tungsten carbide (WC—Co).

Such conventional PCD material comprises about 10 percent by volume of a catalyst material to facilitate intercrystalline bonding between the diamond grains, and to bond the PCD material to the underlying substrate and/or transition layer. Metals conventionally employed as the catalyst are often selected from the group of solvent metal catalysts including cobalt, iron, nickel, and mixtures thereof, found in Group VIII of the Periodic Table.

The amount of catalyst material used to form PCD materials represents a compromise between desired properties of toughness and hardness/wear resistance in the resulting sintered diamond body. While a higher metal catalyst content typically increases the toughness of a resulting PCD material, such higher metal catalyst content also decreases the hardness and corresponding wear and abrasion resistance of the PCD material. Also, as PCD materials are formed with increasing diamond volume fraction there is an increase in thermal mismatch between the sintered PCD and the tungsten carbide substrate creating higher residual stresses near the interface between these materials which residual stresses are undesired as they may promote cracking and/or delamination within the PCD construction.

Thus, these inversely affected desired properties ultimately limit the flexibility of being able to provide PCD materials having desired levels of both wear resistance and toughness to meet the service demands of particular applications, such as cutting and/or wear elements used in subterranean drilling devices. Additionally, when variables are selected to increase the wear resistance of the PCD material, typically brittleness also increases, thereby reducing the toughness and impact resistance of the PCD material.

A further desired property of PCD constructions used for certain applications is that they be thermally stable during wear or cutting operating conditions. A problem known to exist with conventional PCD materials is that they are vulnerable to thermal degradation when exposed to elevated temperatures during cutting and/or wear applications. This vulnerability results from the differential that exists between the thermal expansion characteristics of the metal catalyst disposed interstitially within the PCD material and the thermal expansion characteristics of the intercrystalline bonded diamond. Such differential thermal expansion is known to start at temperatures as low as 400° C., may induce thermal stresses that may be detrimental to the intercrystalline bonding of diamond, and may eventually result in the formation of cracks that may make the PCD structure vulnerable to failure. Accordingly, such behavior is not desirable.

Another form of thermal degradation known to exist with conventional PCD materials is one that is also related to the presence of the metal catalyst in the interstitial regions of the PCD material and the adherence of the solvent metal catalyst to the diamond crystals. Specifically, the solvent metal catalyst is known to cause an undesired catalyzed phase transformation in diamond (converting it to carbon monoxide, carbon dioxide, or graphite) with increasing temperature, thereby limiting practical use of the PCD material to about 750° C.

It is, therefore, desirable that a PCD material be developed that displays improved and optimized combined properties of wear and abrasion resistance, low residual stress, and thermal stability for use in complex wear environments, when compared to conventional PCD materials, while not sacrificing desired properties of toughness, impact resistance, and delamination resistance, making them well suited for use in the same applications.

SUMMARY OF THE INVENTION

Diamond bonded constructions disclosed herein include a diamond body comprising a matrix phase of intercrystalline bonded diamond, and a plurality of interstitial regions dispersed among the bonded diamond. The diamond body has a working surface at one location and an interface surface positioned at another location. The body may be attached to a metallic substrate to form a diamond bonded compact construction. A feature of such diamond bonded constructions is that the diamond body has a gradient diamond volume content that is greater than that otherwise inherently present in conventional diamond bonded constructions. In an example embodiment, the gradient diamond volume content is greater than about 1.5 percent. In an example embodiment, the diamond volume content at the interface surface is less than 94 percent, and increases moving toward the working surface.

In an example embodiment, the diamond body may include a region that is substantially free of a catalyst material that is used to form the diamond bonded construction by HPHT process. The region substantially free of the catalyst material may extend a partial depth from the working surface, wherein the exact depth of this region can and will vary depending on the particular end-use applications.

A further feature of diamond bonded constructions disclosed herein is that the diamond body includes a catalyst material disposed within the interstitial regions. In an example embodiment, the catalyst material volume content changes, e.g., in a gradient manner, with position within the diamond body. In an example embodiment, the catalyst material volume content increases moving from the body working surface towards the interface surface. The diamond body may include an additional material that may have a changing volume content depending on position within the diamond body. In an example embodiment, the volume content of the additional material may provide the desired change in catalyst and/or diamond volume content within the diamond body.

Diamond bonded constructions disclosed herein may be formed by high-pressure HPHT processing, e.g., from 6,200 MPa to 10,000 MPa. Diamond constructions so formed display a diamond volume fraction v. average grain size relationship that is characteristic of the high pressure that is used, and that operates to identify and distinguish diamond bonded constructions so formed from conventional diamond bonded constructions sintered by conventional-pressure HPHT processes. In an example embodiment, diamond bonded constructions formed by high-pressure HPHT process may have a diamond volume content at the working surface according to one of the following criteria: the diamond volume fraction is greater than (0.9077)*(the average diamond grain size$^{0.0221}$); or the diamond volume fraction is greater than (0.9187)*(the average diamond grain size$^{0.0183}$); or the diamond volume fraction is greater than (0.9291)*(the average diamond grain size$^{0.0148}$); wherein the average diamond grain size is provided micrometers.

In another example embodiment, the diamond grain size and diamond volume content at the working surface may meet one of the following criteria: has a sintered average diamond grain size within the range of 2-4 microns, and a has diamond volume fraction greater than 93%; or has a sintered average grain size within the range of 4-6 microns, and has a diamond volume fraction greater than 94%; or has a sintered average grain size within the range of 6-8 microns, and has a diamond volume fraction greater than 95%; or has a sintered average grain size within the range of 8-10 microns, and a has diamond volume fraction greater than 95.5%; or has a sintered average grain size within the range of 10-12 microns, and has a diamond volume fraction greater than 96%.

Diamond bonded constructions and compacts including the same may be used as cutting elements on bits for drilling subterranean formations. The cutting element may be provided in the form of a shear cutter for use on one or more blades of a fixed blade cutter, or may be provided in the form of a cutting insert for use on one or more cones rotatably disposed on a rotary cone bit or rock bit.

Diamond bonded constructions as disclosed herein are engineered to provide improved and optimized combined properties of wear and abrasion resistance, low residual stress, and thermal stability for use in complex wear environments, when compared to conventional PCD materials, while not sacrificing desired properties of toughness, impact resistance, and delamination resistance, making them well suited for use in desired end-use applications.

BRIEF DESCRIPTION OF THE DRAWING

These and other features and advantages of the present invention will become appreciated as the same becomes better understood with reference to the specification, claims and drawings wherein:

FIG. 5 is a perspective side view of the PCD construction embodied in the form of a cutting insert;

FIG. 6 is a perspective side view of a roller cone drill bit comprising a number of the cutting inserts of FIG. 5;

FIG. 7 is a perspective side view of a percussion or hammer bit comprising a number of the cutting inserts of FIG. 5;

DETAILED DESCRIPTION

As used in this specification, the term polycrystalline diamond, along with its abbreviation "PCD," is used herein to refer to the resulting material produced by subjecting individual diamond crystals or grains in the presence of a catalyst material to sufficiently high pressure-high temperature (HPHT) conditions that causes intercrystalline bonding to occur between adjacent diamond crystals to form a network or matrix phase of diamond crystal-to-diamond crystal bonding. The PCD also comprises a plurality of regions that are dispersed within the matrix phase, interstitially between the bonded together diamond grains.

PCD constructions as disclosed herein comprise a polycrystalline diamond body having a volume content of solvent metal catalyst, e.g., cobalt, that increases in a gradient manner moving within the body away from a body working surface and towards a substrate attached to the body. The PCD body may further include an additional interstitial material that may be a carbide. The desired gradient distribution of catalyst material within the body may be achieved though the controlled content of the catalyst material itself, through the use of the additional material in the body to displace and control infiltration of catalyst material therein, or by a combination of both changing the catalyst material content and using such additional material. Such PCD constructions display optimized combined properties of abrasion resistance, thermal stability, fracture toughness and resistance to delamination when compared to conventional PCD construction, e.g., having a relatively constant catalyst material content. PCD construction as disclosed herein may also feature PCD that has been entirely or partially formed at a higher pressure than that used to form conventional PCD, to thereby produce a PCD material or region having a desired high volume fraction of diamond.

Figure 1:
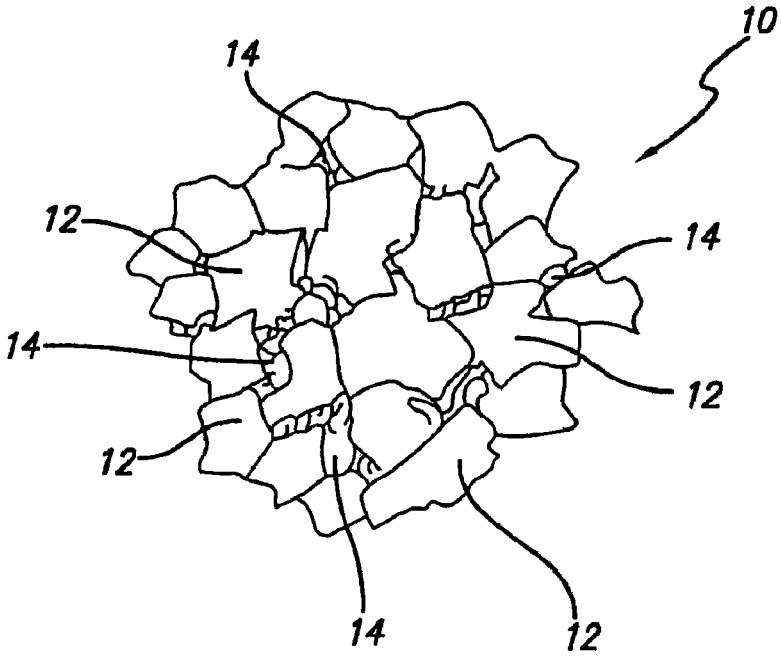
FIG. 1 is a cross-sectional view of a region of PCD material prepared according to this invention.

FIG. 1 illustrates a region of PCD 10 used for forming PCD constructions as disclosed herein, formed/sintered by HPHT process. The PCD material has a material microstructure comprising a matrix phase of intercrystalline diamond made up of a plurality of bonded together adjacent diamond grains 12, and a plurality of interstitial regions 14 disposed between the bonded together adjacent diamond grains. A catalyst material is disposed within the interstitial regions, and is used to facilitate the diamond-diamond bonding that occurs during the HPHT process. As better described below, depending on the location within the PCD body, the interstitial regions may also contain a desired amount of an additional material, e.g., a carbide material, to help provide a desired catalyst material content.

The catalyst material used to facilitate diamond-to-diamond bonding may be provided generally in two ways. It may be provided in the form of a material powder that is mixed or otherwise present with the volume of diamond grains prior to sintering, or it may be provided by infiltration into the volume of diamond grains during HPHT processing from an adjacent material, such as a substrate material comprising the catalyst material, and that is used to bond with the PCD body to form a desired PCD construction.

The diamond grains used to form PCD materials of this invention may be synthetic or natural. In certain applications, such as those calling for an improved degree of control over the amount of catalyst material remaining in the PCD material, it may be desired to use natural diamond grains for their absence of catalyst material entrapped within the diamond crystals themselves. The size of the diamond grains used to make PCD materials of this invention may and will vary depending on the particular end use application, and may consist of a monomodal distribution of diamond grains having the same general average particle size, or may consist of a multimodal distribution (bi, tri, quad, penta or log-normal distribution) of different volumes of diamond grains of different average particle size. Additionally, the HPHT processing pressure may influence the grain size of diamond used to form PCD materials having a particular diamond volume fraction.

Diamond grains useful for forming the PCD material or body may include natural and/or synthetic diamond powders having an average diameter grain size in the range of from submicrometer in size to 100 micrometers, and more preferably in the range of from about 1 to 80 micrometers. The diamond powder may contain grains having a mono or multimodal size distribution. In an example embodiment, the diamond powder has an average particle grain size of approximately 20 micrometers. In the event that diamond powders are used having differently sized grains, the diamond grains are mixed together by conventional process, such as by ball or attritor milling for as much time as necessary to ensure good uniform distribution.

The diamond grain powder is preferably cleaned, to enhance the sinterability of the powder by treatment at high temperature, in a vacuum or reducing atmosphere. The diamond powder mixture is loaded into a desired container for placement within a suitable HPHT consolidation and sintering device.

The diamond powder may be combined with a desired catalyst material, e.g., a solvent metal catalyst such as those described below, in the form of a powder to facilitate diamond bonding during the HPHT process and/or the catalyst material may be provided by infiltration from a substrate positioned adjacent the diamond powder and that includes the catalyst material. Suitable substrates useful as a source for infiltrating the catalyst material may include those used to form conventional PCD materials, and may be provided in powder, green state, and/or already sintered form. A feature of such substrate is that it includes a metal solvent catalyst that is capable of melting and infiltrating into the adjacent volume of diamond powder to facilitate bonding the diamond grains together during the HPHT process. In an example embodiment, the catalyst material is cobalt (Co), and a substrate useful for providing the same is a Co containing substrate, such as WC—Co.

If desired, the diamond mixture may be provided in the form of a green-state part comprising a volume of diamond powder that is combined with a binding agent to provide a conformable material product, e.g., in the form of diamond tape or other formable/conformable diamond mixture product to facilitate the manufacturing process. In the event that the diamond powder is provided in the form of such a green-state part, it is desirable that a preheating step take place before HPHT consolidation and sintering to drive off the binder material. The green-state part may or may not include the catalyst material.

In addition to the diamond grains, it may be desired that an additional material be added that is capable of offsetting and controlling the presence, infiltration, and/or migration of the catalyst material within the diamond volume during the HPHT process to provide the desired catalyst material distribution within the body. Example additional materials include those selected from the group including carbides, nitrides, borides, oxides and combinations thereof. Such additional material may further be combined with Group IVa metals such as Ti, Zr and Hf, Group Va metals such as V, Nb and Ta, and Group VIa metals such as Cr, Mo and W of the Periodic table. In an example embodiment, a desired additional material is a carbide.

In an example embodiment, the additional material is combined with the diamond volume in such a manner so that the volume of the additional material changes moving from what will be a working surface of the sintered diamond body formed therefrom. In an example embodiment, the volume of the additional material within the diamond volume mixture is greatest at the working surface and decreases moving away therefrom. The volume of the additional material preferably changes in gradient fashion within the diamond body, to provide a converse gradient change in the catalyst material volume content.

It is to be understood that a small amount of diamond volume gradient is inherent in PCD constructions sintered with a WC—Co substrate. Such inherent diamond volume gradients have been observed to be approximately 1.5 volume percent or less, with the higher volume fraction being at the working surface and the lower being at the interface with a continuous gradient in between. Such diamond volume fraction changes are inherent because the substrate causes a sintering constraint and does not allow the material to shrink freely, while in comparison the working surface has no such constraint. This difference in shrinkage causes a relative increase in void spaces near the interface region which fill with infiltrated cobalt and to some degree tungsten carbide. PCD materials and constructions disclosed herein are specifically engineered having an enhanced or increased diamond volume gradient beyond the amount noted above inherent in PCD synthesis.

The intrinsic or inherent gradients of diamond, cobalt and tungsten carbide in conventional PCD products (designated as D21 and D31) are shown below in Table 1. These PCD products were both fabricated using powders having an average particle size of approximately 12 microns. The composition gradients were determined by energy dispersive spectroscopy (EDS) calibrated against bulk PCD density measurements. The composition gradients were converted to volume fractions using standard metallurgical procedures using the known densities of the diamond, cobalt, and tungsten carbide phases (respectively 3.51, 8.85, and 15.7 gm/cc). An alternative method for characterizing the volume fraction gradients is image analysis using scanning electron microscopy (SEM), although great care must be taken in collection and analysis to accurately capture images of the desired phases while minimizing contrast bias and effects such as electron beam charging.

TABLE 1

| Inherent PCD Constituent Gradients | | | | | | |
|---|---|---|---|---|---|---|
| | Dia wt % | Co wt % | WC wt % | Dia vol % | Co vol % | WC vol % |
| Prior Art (D21) Surface | 0.845 | 0.121 | 0.034 | 0.938 | 0.053 | 0.008 |
| Prior Art (D21) Interface | 0.82 | 0.129 | 0.051 | 0.929 | 0.058 | 0.013 |
| Prior Art (D31) Surface | 0.834 | 0.111 | 0.055 | 0.937 | 0.049 | 0.014 |
| Prior Art (D31) Interface | 0.802 | 0.133 | 0.065 | 0.923 | 0.061 | 0.017 |

Referring back to the method of making the PCD material, the combined diamond volume and additional material may be provided in powder form as a powder assembly, or may be provided in the form of a green-state volume or thickness, e.g., in the form as a tape, comprising a binding agent to retain the desired placement of the powder agents. As noted above the combined diamond volume may include the catalyst material or the catalyst material may be provided by infiltration from the substrate during the HPHT process.

The diamond powder mixture or green-state part is loaded into a desired container for placement within a suitable HPHT consolidation and sintering device. The HPHT device is activated to subject the container to a desired HPHT condition to consolidate and sinter the diamond powder. In an example embodiment, the device is controlled so that the container is subjected to a HPHT process having a pressure of 5,000 MPa or greater and a temperature of from about 1,350° C. to 1,500° C. for a predetermined period of time. At this pressure and temperature, the catalyst material melts and infiltrates into the diamond powder mixture, thereby sintering the diamond grains to form PCD.

Standard HPHT pressure conditions conventionally used to form PCD are internal cold cell pressures in the range of from about 5,000 to 6,200 MPa (measured by the manganin resistance method, calibrated with bismuth and ytterbium transitions, a technique known in the industry). In one embodiment, a PCD body with high diamond content is provided. PCD with high diamond content may be characterized as PCD with a high diamond volume fraction. The diamond volume fraction refers to the ratio by volume of diamond to the overall volume of the PCD region of interest (i.e., a portion of the PCD body (e.g., first or second regions) or the entire PCD body). High diamond content may also be characterized by the apparent porosity of the PCD sample, and the leaching weight loss.

Figure 10:
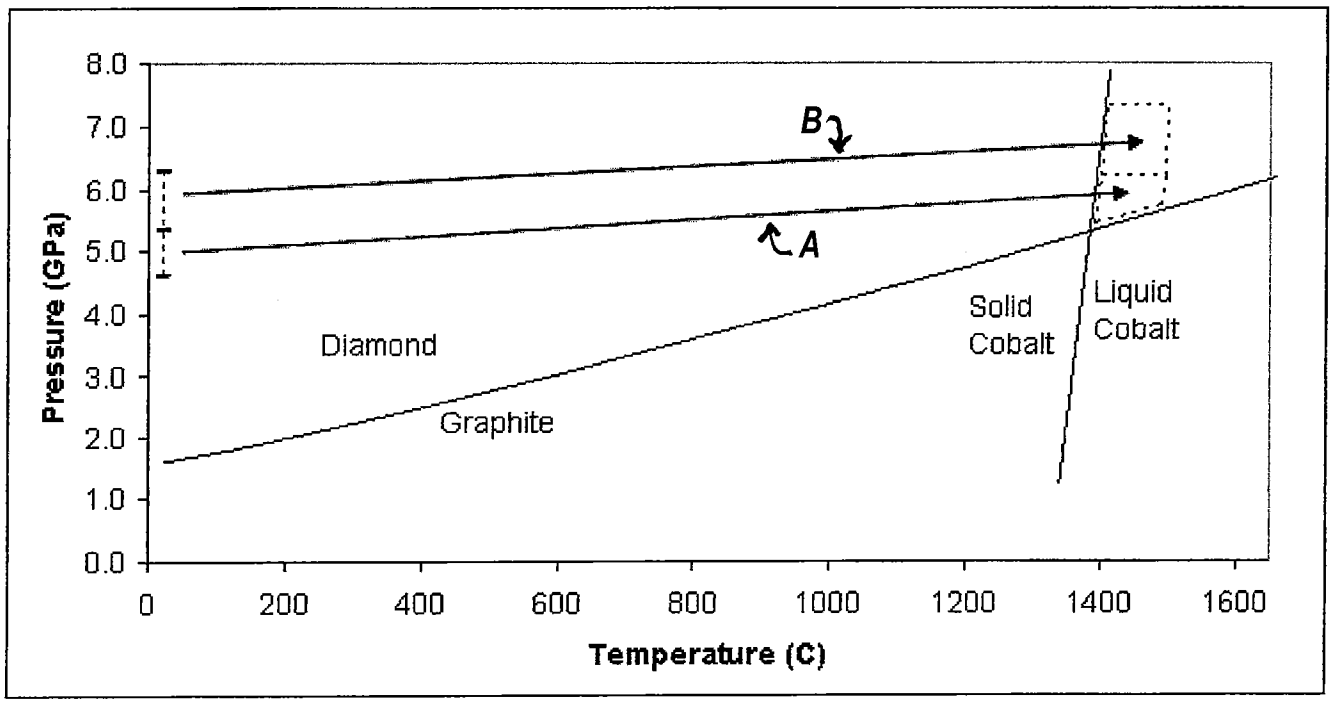
FIG. 10 is a graph illustrating conventional sintering pressure and high sintering pressure on the diamond pressure versus temperature phase diagram.

In one embodiment, PCD with high diamond content is formed by HPHT sintering at higher than normal pressures, as shown for example in FIG. 10. FIG. 10 shows a diagram of the pressures and temperatures used to create PCD (as is known in the art illustrated as line "A") and PCD with high diamond content (according to embodiments of the present disclosure illustrated as line "B:). The diagram includes two lines dividing the diagram into four quadrants. The more horizontal line is the diamond/graphite equilibrium line, which is well known to those skilled in the art as the Berman-Simon line. Diamond is thermodynamically stable at pressures above this line. The more vertical line is the Co—C eutectic line, adopted from FIG. 16.7 of Field's well known reference book Properties of Diamond, Academic Press, 1979. At temperatures to the right of this line, cobalt is liquid in form, and at temperatures to the left, it is in solid form. In industrial practice, diamond is formed in the top right quadrant, above the diamond/graphite line and to the right of the cobalt line.

As indicated by line "A", standard HPHT pressures used to create PCD are internal cold (room temperature) cell pressures in the range of approximately 4,600 to 5,500 MPa (megapascals) (measured by the manganin resistance method, calibrated with bismuth and ytterbium transitions, a technique well known in the industry). This pressure range becomes approximately 5,500 to 6,200 MPa as temperatures are increased beyond the cobalt line, due to thermal expansion of the cell materials. The effect of temperature on cell pressure may be assessed using techniques known in the industry, such as the melting point of gold. The lower pressure limit is determined by the diamond/graphite line of the phase diagram.

For PCD material having a high diamond volume content, for optimal wear properties, it may be desirable to use an HPHT processing pressure of 6,200 MPa or greater, e.g., in the range of from about 6,200 to 10,000 MPa illustrated by line "B" as temperatures are increased past the cobalt/carbon eutectic line. In exemplary embodiments, the pressure (at high temperature) is in the range of approximately 6,200 to 7,200 MPa. In various embodiments, the cell pressure (at high temperature) may be greater than 6,200 MPa, for example in the range of from greater than 6,200 MPa to 8,000 MPa or from 8,000 MPa to 10,000 MPa, such as 6,250 MPa, 7,000 MPa, 7,500 MPa, 8,000 MPa, 8,500 MPa, 9,000 MPa, or 9,500 MPa. The temperatures used in both standard HPHT sintering and the higher pressure HPHT sintering are similar as disclosed above, although the use of higher pressures allows for additional temperature to be applied if necessary and if capsule materials and designs allow this.

PCD samples comprising four diamond powder mixtures were sintered at the following three different pressures (hydraulic fluid pressures of 10.2 ksi, 11 ksi, and 12 ksi) (which correlate to internal cold cell pressures of 5.4 GPa, 5.8 GPa, and 6.2 GPa, and internal hot cell pressures of 6.2 GPa, 6.7 GPa, and 7.1 GPa). These samples were tested according to the "Density" method to determine and compare the diamond volume fraction of the samples.

The "Density" third method calculates the diamond volume fraction of the PCD sample. This method does not require leaching of the PCD sample. Instead, the bulk density of the sample is measured, and the ratios of metal components and diamond are measured to determine the volume fractions of these components. This method includes determining the component mass fractions by analytical methods. Determination of the binder composition may employ one of many techniques, including energy dispersive spectroscopy (EDS), wavelength dispersive spectroscopy (WDS), x-ray fluorescence (XRF), inductively coupled plasma (ICP), or wet chemistry techniques. Because of its frequent usage in scanning electron microscopes, EDS is commonly used to quantitatively assess PCD specimens. However, EDS may not accurately determine low atomic number elements such as carbon accurately without arduous effort, which causes problems in a material such as PCD. Despite this known limitation, if the cobalt/tungsten ratio of the binder phase is known with reasonable accuracy, then the composition may be reasonably determined if the bulk density of the sample is known.

To determine if the analytical method is sufficiently calibrated, analysis of a known cemented carbide sample should be performed. Sufficient accuracy is obtained if the cobalt elemental composition is within 0.5% and the tungsten elemental composition is within 1.5% (i.e. a WC-13 wt % Co should give 12.5-13.5 wt % cobalt and 80.1-83.1 wt % tungsten). More reliable EDS results on PCD samples are obtained when the sample is polished to mirror surface finish by polishing with a diamond-containing grinding surface (e.g., a grinding wheel) similar to the method subsequently described for EBSD sample preparation. A low magnification 10-100× is typically used in order to maximize the sampling region. Various working distances and accelerating voltages may be employed, however working distances of 10-11 mm and accelerating voltage of 20 kilovolts have given acceptable results. When analyzing a sample, the total time should include a live collection time of 30-60 seconds with a dead time of 25-35%. The EDS measured mass fractions may be used to determine a value for a constant k (see Equation 1 below). This constant k along with the measured density of the PCD body (ρS above) may be used to obtain the calculated mass fractions of the diamond, catalyst and metal carbide (see Equations 2 to 4 below). The calculated volume fraction of diamond, catalyst and metal carbide may then be determined from the calculated mass fractions (see Equations 5 to 7 below).

$$k = m_{catalyst}/m_{metal\ carbide} \quad \text{(Equation 1)}$$

where:

$m_{catalyst}$ is the mass fraction determined from EDX spectroscopy $m_{metal\ carbide}$ is the mass fraction of the metal component in the metal carbide determined from EDX spectroscopy For example, if the catalyst material is cobalt and the metal carbide is tungsten carbide, the following equations may be used to calculate the mass fractions of the diamond (mdia), cobalt (mco), and tungsten carbide (mwc) in the PCD body:

$$m_{dia} = 1 - \frac{(\rho_{dia} - \rho)}{\rho}\left[\frac{\rho_{co}\rho_{wc}(k+1)}{\rho_{dia}\rho_{co} + \rho_{wc}\rho_{dia}k - \rho_{wc}\rho_{co}(k+1)}\right] \quad \text{(Equation 2)}$$

$$m_{co} = \frac{(\rho_{dia} - \rho)}{\rho}\left[\frac{\rho_{co}\rho_{wc}k}{\rho_{dia}\rho_{co} + \rho_{wc}\rho_{dia}k - \rho_{wc}\rho_{co}(k+1)}\right] \quad \text{(Equation 3)}$$

$$m_{wc} = \frac{(\rho_{dia} - \rho)}{\rho}\left[\frac{\rho_{co}\rho_{wc}}{\rho_{dia}\rho_{co} + \rho_{wc}\rho_{dia}k - \rho_{wc}\rho_{co}(k+1)}\right] \quad \text{(Equation 4)}$$

where:

$\rho_{dia}$=3.51 gm/cc $\sigma_{co}$=8.85 gm/cc $\rho_{wc}$=15.7 gm/cc

ρ=measured density of the PCD sample

From the calculated mass fractions, the volume fractions may be calculated for diamond ($v_{dia}$), cobalt ($v_{co}$) and tungsten carbide ($v_{wc}$) in the PCD body using the following equations:

$$v_{dia} = \left[\frac{m_{dia}/\rho_{dia}}{m_{dia}/\rho_{dia} + m_{co}/\rho_{co} + m_{wc}/\rho_{wc}}\right] \quad \text{(Equation 5)}$$

$$v_{co} = \left[\frac{m_{co}/\rho_{co}}{m_{dia}/\rho_{dia} + m_{co}/\rho_{co} + m_{wc}/\rho_{wc}}\right] \quad \text{(Equation 6)}$$

$$v_{wc} = \left[\frac{m_{wc}/\rho_{wc}}{m_{dia}/\rho_{dia} + m_{co}/\rho_{co} + m_{wc}/\rho_{wc}}\right] \quad \text{(Equation 7)}$$

One skilled in the art would appreciate that the mass fractions and volume fractions may be determined in a similar way when using a catalyst material other than cobalt and a metal carbide other than tungsten carbide, and the above equations may be modified as appropriate if significant amounts of additional materials are present.

The measurements of the PCD samples resulting from Density method are shown in Table 2:

TABLE 2

| Density | | | | | | | |
|---|---|---|---|---|---|---|---|
| Mixture | Pressure (ksi) | Co wt % (EDS) | W wt % (EDS) | Co/W Ratio | Sample Density (gm/cc) | Diamond Vol Fraction | Sintered Average Grain Size (micron) |
| 1 | 10.2 | 10.51 | 2.32 | 4.53 | 3.874 | 0.9615 | 13.5 |
| 2 | 10.2 | 11.41 | 3.12 | 3.66 | 3.902 | 0.9559 | 9.8 |
| 3 | 10.2 | 12.15 | 3.62 | 3.36 | 3.955 | 0.9499 | 8.2 |
| 4 | 10.2 | 15.01 | 5.29 | 2.84 | 4.076 | 0.9295 | 2.9 |
| 1 | 11 | 11.43 | 3.2 | 3.57 | 3.844 | 0.9639 | 13.5 |
| 2 | 11 | 11.54 | 3.01 | 3.83 | 3.881 | 0.9587 | 9.8 |
| 3 | 11 | 12.01 | 3.36 | 3.57 | 3.930 | 0.9532 | 8.2 |
| 4 | 11 | 14.83 | 6.28 | 2.36 | 4.046 | 0.9371 | 2.9 |
| 1 | 12 | 10.53 | 2.89 | 3.64 | 3.827 | 0.9653 | 13.5 |
| 2 | 12 | 14.42 | 5.740 | 2.51 | 3.857 | 0.9619 | 9.8 |
| 3 | 12 | 11.97 | 4.02 | 2.98 | 3.907 | 0.9580 | 8.2 |
| 4 | 12 | 16.33 | 5.24 | 3.12 | 4.009 | 0.9439 | 2.9 |

Figure 2:
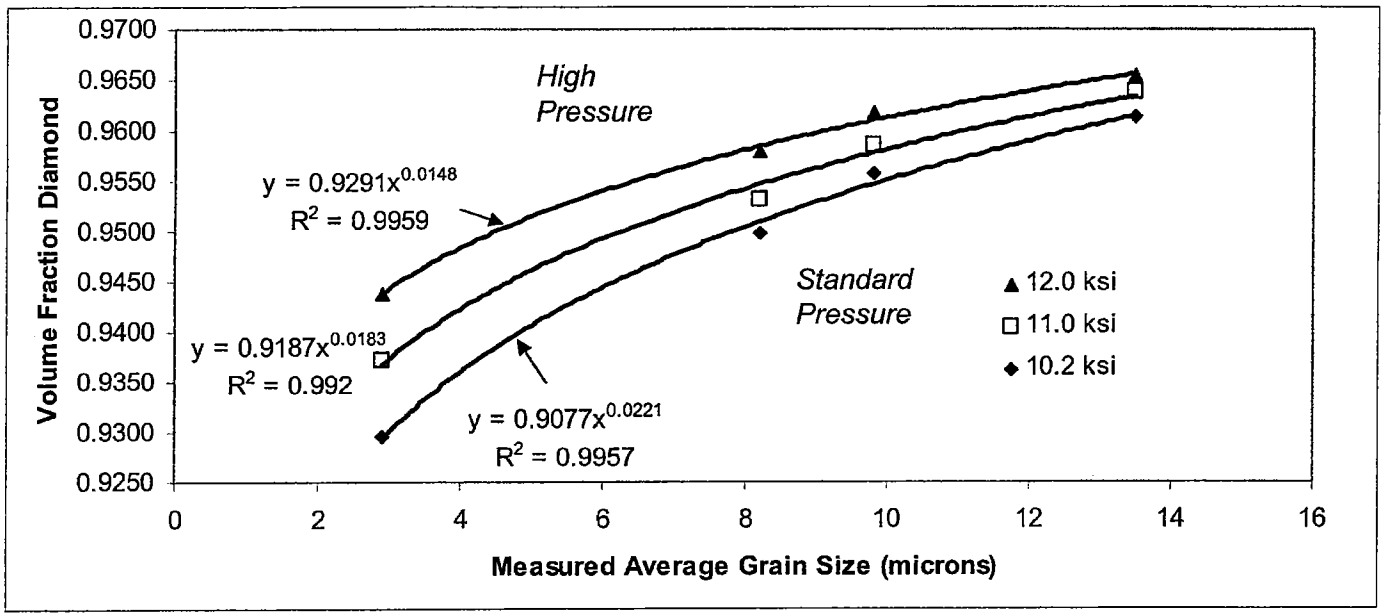
FIG. 2 is a graph presenting the relationship of diamond volume fraction to diamond grain size at different HPHT processing conditions.

This data is also plotted in FIG. 2, which shows the diamond volume fraction versus the measured average sintered grain size. As shown in FIG. 2, the relationship between diamond volume fraction and average grain size followed the same trend for the three different sintering pressures. Curve fits were applied to the data, and the resulting equations are shown on the chart for each sintering pressure. FIG. 2 shows that the diamond volume fraction depends on the average grain size of the PCD sample. The diamond volume fraction increases with average grain size (as shown by the upward slope). For a given sintering pressure, increasing the average grain size leads to an increase in diamond volume fraction. This result is likely due to fracturing of the coarser diamond grains, as discussed above.

Additionally, for a given grain size, increasing the sintering pressure led to an increase in the diamond volume fraction. This is due to the higher pressure causing additional compaction of the diamond grains, resulting in smaller voids between the sintered diamond crystals, and a higher density of diamond.

The curve fit for the 10.2 ksi data in FIG. 2 identifies the boundary between high and standard sintering pressures. Thus, a PCD sample may be identified as having been sintered at high sintering pressure by measuring the average grain size and the diamond volume fraction of the sample. For a given grain size, if the diamond volume fraction is above the 10.2 ksi line, then the sample was sintered at higher than standard sintering pressures. If the diamond volume fraction is below the 10.2 ksi line, then the sample was sintered at standard pressures.

Accordingly, PCD with high diamond content, formed by sintering at higher than normal pressures, may be identified as follows (with average grain size in microns):

PCD with a diamond volume fraction greater than (0.9077) *(the average grain size$^{0.0221}$), or PCD with a diamond volume fraction greater than (0.9187) *(the average grain size$^{0.0183}$), or PCD with a diamond volume fraction greater than (0.9291) *(the average grain size$^{0.0148}$), or PCD with a diamond volume fraction greater than one of the following values and an average grain size within the corresponding range:

| Sintered Average Grain Size (micron) | Diamond Volume Fraction (12 ksi) | Diamond Volume Fraction (11 ksi) | Diamond Volume Fraction (10.2 ksi) |
|---|---|---|---|
| 2-4 | 0.939 | 0.930 | 0.922 |
| 4-6 | 0.948 | 0.942 | 0.936 |
| 6-8 | 0.954 | 0.949 | 0.944 |
| 8-10 | 0.958 | 0.954 | 0.950 |
| 10-12 | 0.961 | 0.958 | 0.955 |

Based on the relationships shown in FIG. 2, in an example embodiment, a PCD sample with high diamond content includes a sintered average grain size within the range of 2-4 microns, and a diamond volume fraction greater than 93%; or a sintered average grain size within the range of 4-6 microns, and a diamond volume fraction greater than 94%; or a sintered average grain size within the range of 6-8 microns, and a diamond volume fraction greater than 95%; or a sintered average grain size within the range of 8-10 microns, and a diamond volume fraction greater than 95.5%; or a sintered average grain size within the range of 10-12 microns, and a diamond volume fraction greater than 96%.

As shown in FIG. 2, the coarser diamond powder mixtures with larger nominal grain size resulted in PCD bodies with a lower metal content. This is likely due to the fracturing of the larger diamond crystals during the HPHT sintering. Finer diamond crystals are more resistant to fracturing than the larger diamond crystals, which fracture and rearrange themselves under pressure, compacting and packing more effectively into the spaces between the crystals and leaving less space for metal from the substrate. Thus, shifting the average grain size of the diamond powder mixture into a more coarse grain size may lead to a PCD layer with a lower metal content.

The average sintered grain size of a PCD sample may be determined by an electron back scatter diffraction (EBSD) technique, as follows. A suitable surface preparation is achieved by mounting and surfacing the PCD sample using standard metallographic procedures, and then subsequently producing a mirror surface by contact with a commercially available high speed polishing apparatus (available through Coborn Engineering Company Limited, Romford, Essex, UK). The EBSD data is collected in a scanning electron microscope suitably equipped to determine grain orientation by localized diffraction of a directed electron beam (available through EDAX TSL, Draper, Utah, USA). Magnification is selected such that greater than 1000 grains were included in a single image analysis, which was typically between 500×-1000× for the grain sizes examined. During the inventors' testing, other conditions were as follows: voltage=20 kV, spot size=5, working distance=10-15 mm, tilt=70°, scan step=0.5-0.8 microns. Grain size analysis is performed by analysis of the collected data with a misorientation tolerance angle=2°. Defined grain areas determined according to the above conditions are sized according to the equivalent diameter method, which is mathematically defined as $GS=(4A/\pi)^{1/2}$, where GS is the grain size and A is the grain area. This analysis provided the average grain size for each of the sintered PCD samples presented above.

Accordingly, it is understood that PCD materials and constructions disclosed herein may be formed by subjecting the diamond volume to an HPHT process operated at the higher than conventional processing pressures noted above. Additionally, PCD materials as disclosed herein may be formed entirely using a single HPHT process that is operated at the standard pressure or the higher than standard pressure, or may comprise two or more regions that are formed at different HPHT pressure conditions. For example, an example PCD material may comprise a region extending a depth from a working surface that is formed by an HPHT process operated at the higher than standard pressure, and a region extending from a substrate interface surface that is formed by an HPHT process operated at the standard pressure. For a given grain size, such differences in HPHT processing for these regions will provide an increased diamond volume fraction at the working surface where it is most needed, while providing a relatively lower diamond volume fraction adjacent the substrate interface to minimize thermal coefficient mismatch with the substrate and thereby reduce unwanted residual stress.

In an example embodiment, the additional material within the diamond volume operates to control the content and/or distribution of the catalyst material within the PCD material to provide a desired low catalyst material volume content at the working surface, and a desired gradient catalyst material volume change within the PCD material. In the event that a substrate is used during the HPHT process, e.g., as a source of the catalyst material, the substrate is attached to the PCD material or body during the HPHT process. After the HPHT process is completed, the container is removed from the HPHT device, and the so-formed PCD material is removed from the container.

PCD constructions as disclosed herein are specially engineered having a gradient catalyst material volume content. The catalyst material volume content is the lowest at a working surface of the PCD body to thereby provide properties of high abrasion resistance and thermal stability at the working surface where it is most needed. Desired properties of fracture toughness and impact strength are also provided within the PCD body beneath the working surface by an increased volume content of the catalyst material moving towards the substrate. Additionally, an increased catalyst material volume content at the substrate interface helps to ensure that a strong attachment bond exists between the substrate and the PCD body to thereby provide improved resistance against unwanted delamination. In addition, the decreased diamond content at the interface decreases inherent residual stresses, further reducing the risk of PCD delamination.

The diamond content gradient may be introduced by a progressive increase in pre-blended solvent catalyst from the working surface to the interface, by the addition of an additional solid phase material besides the diamond and solvent catalyst phases as noted above, or a combination of the two. The solvent catalyst approach may be employed by layering unsintered powders of diamond with different amounts of catalyst material on a tungsten carbide substrate. Alternatively, diamond and catalyst powder containing progressively increasing amounts of an alternative solid phase material may be layered in a similar manner. Still further, powder layers of diamond, catalyst and the additional material may be layered, wherein the amount both the catalyst and the additional material vary within the layers to achieve the desired gradient. In a preferred embodiment the additional material is carbide, and is more preferably tungsten carbide.

It is desired that diamond volume fraction gradient within the PCD material exceed the intrinsic gradient mentioned previously (i.e., be greater than about 1.5 volume percent). As noted above, the gradient within the PCD body may be created by: (1) varying the catalyst material, e.g., cobalt, content (shown in Table 3 below as Gradient A); (2) by varying the amount of an additional or solid phase material (Gradient B); or (3) by a combination of both (Gradient C). Table 3 presents example material gradients in volume and weight percent for each of these approaches. A feature of the PCD materials disclosed herein and as presented in Table 3 is that they have a diamond volume fraction gradient between about 5.0 to 5.5 percent. However, it is understood that PCD materials as disclosed herein may have diamond volume gradients in other ranges, such as greater than 1.5 volume percent and less than 5 volume percent, and such as greater than 5 volume percent depending on the particular end-use application. Additionally, to minimize residual stresses in the interface region it is generally desired that the diamond volume content be below about 94 percent at the interface.

TABLE 3

Example Embodiment PCD Material Constituent Gradients

| | Dia wt % | Co wt % | WC wt % | Dia vol % | Co vol % | WC vol % |
|---|---|---|---|---|---|---|
| Gradient A: Surface | 0.880 | 0.090 | 0.030 | 0.954 | 0.039 | 0.007 |
| Gradient A: Interface | 0.779 | 0.191 | 0.030 | 0.904 | 0.088 | 0.008 |
| Gradient B: Surface | 0.880 | 0.100 | 0.020 | 0.952 | 0.043 | 0.005 |
| Gradient B: Interface | 0.720 | 0.100 | 0.180 | 0.900 | 0.050 | 0.050 |
| Gradient C: Surface | 0.890 | 0.090 | 0.020 | 0.957 | 0.038 | 0.005 |
| Gradient C: Interface | 0.750 | 0.140 | 0.110 | 0.903 | 0.067 | 0.030 |

In an example embodiment, where the second phase material gradient within the PCD material is achieved without the use of an additional material by changing the volume content of the catalyst material used to form the same, the volume content of catalyst material used to form the PCD material may be within the range of from about 1 to 10 percent. The use of the catalyst material within this range provides a PCD material having a gradient diamond volume content of from about 90 to 98 percent that increases moving from the substrate to a working surface depending on the grain size of the PCD material.

In another example embodiment, wherein the second phase material gradient within the PCD material is achieved through the use of an additional material by changing the volume content of such additional material, the volume content of such additional material used to form the PCD material may be within the range of from about 1 to 10 percent. The use of the additional material within this range provides a PCD material having a gradient diamond volume content of from about 90 to 98 percent that increases moving from the substrate to a working surface depending on the grain size of the PCD material.

In still another example embodiment, wherein the second phase material gradient within the PCD material is achieved through the use of an additional material by changing the volume content of both the additional material and the catalyst material, the volume content of the catalyst material may be within the range of from about 1 to 10 percent, and the volume content of the additional material may be within the range of from about 90 to 98 percent. The use of the additional material within this range provides a PCD material having a gradient diamond volume content of from about 90 to 98 percent that increases moving from the substrate to a working surface depending on the grain size of the material.

In an example embodiment, where an additional material is provided to achieve a desired gradient within the PCD body, such additional material is present in the range of from about 1.5 to 15 percent by volume, preferably in the range of from about 2 to 10 percent by volume, and more preferably in the range of from about 2.5 to 8 percent by volume.

Using less than about 1.5 percent by volume of the additional material in this example embodiment may not be sufficient to provide the desired low catalyst material content at the working surface and the desired gradient changes in catalyst material within the PCD body. Using greater that about 15 percent by volume of the additional material in this example embodiment may be greater than that necessary to provide a desired low catalyst material content at the working surface, and may additionally result in providing an over-sufficient catalyst material content within the PCD which may not give the desired levels of diamond/diamond bonding.

Additionally, for those example embodiments where an additional material is used to achieve a desired catalyst material gradient within the diamond body, it is desired that the ratio of catalyst material to additional material be balanced to promote optimum thermal stability within the diamond body. In an example embodiment, it is desired that the ratio of catalyst material to carbide within the diamond body is in the range of from about 6:1 to 1:10, preferably in the range of from about 3:1 to 1:6, and more preferably be the range of from about 4:1 to 1:4. A preferred ratio of catalyst material to additional material at the PCD body working surface is in the range of from about 3:1 to 1:4, and a preferred ratio of catalyst material to carbide at the PCD body-substrate interface surface is in the range of from about 1:1 to 1:10.

It is desired that such PCD bodies as disclosed herein have a diamond volume content that is greater than about 85 percent, and preferably in the range of from about 85 to 98. The volume content in the PCD body may be constant throughout the body or may vary depending on the location within the body. For example, in an embodiment where the diamond content varies within the body, the PCD body may have a diamond volume content at the working surface of at least about 92 percent, and a decreasing diamond volume content moving away from the working surface. The change in diamond volume content within the body may occur in a gradient or stepped fashion.

If desired, PCD bodies may be formed having differently sized diamond grains positioned in different locations of the body. For example, the PCD body may be constructed having a region of fine-sized diamond grains positioned along a working surface and coarse-sized diamond grains positioned adjacent the substrate interface. This is just one example of how the PCD body may comprise differently sized diamond grains. Additionally, the transition of differently-sized diamond grains in the PCD body may take place in a stepped or gradient fashion. As shown in FIG. 2, a HPHT process using higher pressure may operate to promote forming a PCD body, or a region thereof, from fine-sized diamond while also providing a desired high diamond volume fraction.

Catalyst materials useful for forming the PCD body may include solvent metal catalysts typically used for forming conventional PCD, such as the metals found in Group VIII of the Periodic table. Example solvent metal catalysts include Co, Ni, Fe and mixtures thereof. As discussed above, the properties of wear and abrasion resistance and toughness and impact resistance of the PCD material are inversely related to one another, and are dependent on the relative amounts of catalyst material and diamond grains that are used.

Example embodiment PCD bodies comprise a gradient volume of the catalyst material as described above. In a preferred embodiment, the volume content of the catalyst material at a working surface is less than about 7 percent. The maximum volume content of the catalyst material may be approximately 10 percent, and exists along the interface with the substrate. In an example embodiment, the volume content of the catalyst material in the diamond body may be from 2 to 10 percent, depending on the particular location within the body and the grain size of the material.

For applications calling for high levels of abrasion resistance and/or thermal stability and low levels of fracture toughness, the catalyst content at the working surface may be close to zero, as the catalyst material in a region of the diamond body extending from the working surface may be leached or otherwise treated to remove the catalyst material therefrom, and the volume content of catalyst material in the diamond body extending from this treated region may be an amount sufficient to provide a desired degree of bond strength between the PCD body and substrate. Additionally, if desired, the entire PCD material may be treated to remove the catalyst material therefrom, leaving a diamond-bonded body that is substantially free of the catalyst material. Such treated PCD material may have a remaining phase of any additional material and/or may have a varying diamond volume content.

Suitable materials useful as substrates for forming PCD constructions include those conventionally used as substrates for conventional PCD compacts for the purpose of attaching the compact to a desired cutting or wear tool. Suitable substrate materials include those formed from metallic materials, ceramic materials, cermet materials, and mixtures thereof. In an example embodiment, the substrate is provided in a preformed state. Alternatively, the substrate may be provided in the form of a mixture of substrate precursor powders, or may be provided in the form of a green-state part.

In an example embodiment, the substrate includes a catalyst material in the form of a metal solvent catalyst that is capable of infiltrating into the adjacent diamond powder during processing to facilitate diamond-to-diamond bonding to form the body, and to provide an integrally bonded attachment therewith to form the PCD compact. Suitable metal solvent catalyst materials include those discussed above in reference to the catalyst material. A particularly preferred metal solvent catalyst is Co. In a preferred embodiment, the substrate material comprises WC—Co.

If desired, the substrate and PCD material may be configured having planar interfacing surfaces, or may be configured having nonplanar interfacing surfaces. In certain applications calling for a high level of bond strength in the PCD compact between the PCD body and the substrate, the use of a nonplanar interface may be desired to provide an increased surface area between the adjoining surfaces to enhance the extent of mechanical coupling and load carrying capacity therebetween. The nonplanar interface may be provided in the form of a single or multiple complementary surface features disposed along each adjacent PCD body and substrate interface surface.

Figure 3:
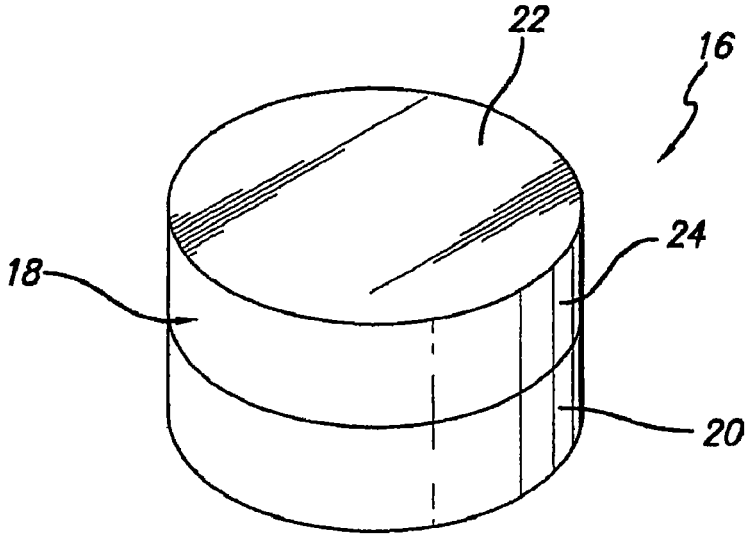
FIG. 3 is perspective side view of an example embodiment PCD construction comprising a PCD body, comprising the PCD material of FIG. 1, joined to a substrate.
Figure 4:
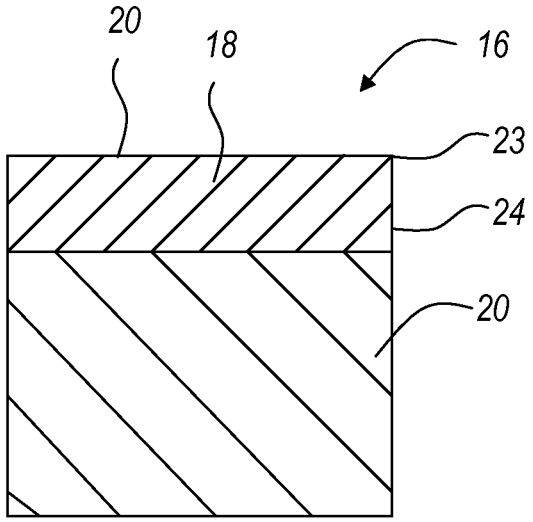
FIG. 4 is a cross-sectional side view of the PCD construction of FIG. 3.

FIGS. 3 and 4 illustrate an example embodiment PCD construction 16 comprising a PCD body 18 as described above, having a gradient catalyst volume content with or without an additive material disposed therein. The catalyst and any additive materials are disposed in the interstitial regions of the PCD material microstructure. The PCD body 18 is integrally joined to a substrate 20, e.g., during HPHT processing as disclosed above. In this example embodiment, the PCD construction has a generally planar working surface 20 positioned along a top portion of the PCD body. Additionally, depending on the particular end-use application, an edge surface 23 and/or all or part of the side surface 24 of the PCD body may also serve as working surfaces. As noted above, the volume content of the catalyst material at the working surface is less than about 7 percent, and increases moving towards the substrate.

While a particular embodiment of the PCD construction has been illustrated, namely, one having a generally flat working surface and a cylindrical outside wall surface, it is to be understood that the particular configuration of PCD constructions may and will vary depending on the particular end-use application, and such variations in configuration are intended to be within the scope of this invention.

As mentioned briefly above, PCD bodies of this invention may be constructed having a single homogeneous PCD phase or region comprising a single or constant diamond volume content, or may constructed comprising two or more PCD phases or regions that each have a different diamond volume content. For PCD body embodiments comprising different regions having different diamond volume contents, the particular diamond volume content in the different regions may and will vary depending as the particular PCD construction configuration and end-use application.

A feature of PCD constructions of the invention, comprising a low catalyst content along a working surface and gradient increasing catalyst content within the body, is that they provide an optimum combination of abrasion resistance, thermal stability, fracture toughness, and resistance to unwanted delamination at places in the PCD body where such properties are needed most. For example, properties of improved abrasion resistance and thermal stability are provided at the PCD body working surface, while an optimum distribution of PCD strength and fracture toughness is provided in the PCD body directly beneath the working surface, and an improved resistance to unwanted delamination is provided at the interface with the substrate.

PCD constructions of this invention may be configured for use in a number of different applications, such as cutting and/or wear elements for tools used for mining, cutting, machining and construction applications, where the combined properties of thermal stability, wear and abrasion resistance, and strength, toughness and impact resistance, and resistance to delamination are highly desired. PCD constructions of this invention are particularly well suited for forming working, wear and/or cutting surfaces on components used in machine tools and subterranean drill and mining bits, such as roller cone rock bits, percussion or hammer bits, diamond bits, and shear cutters.

FIG. 5 illustrates an example embodiment PCD construction provided in the form of an insert 76 used in a wear or cutting application in a roller cone drill bit or percussion or hammer drill bit. For example, such PCD inserts 76 are constructed having a substrate 78, formed from one or more of the substrate materials disclosed above, that is attached to a PCD body 80 constructed in the manner described above having a gradient catalyst material content. In this particular embodiment, the PCD insert 76 comprises a domed working surface 82. The insert 76 may be pressed or machined into the desired shape. It is to be understood that PCD constructions of this invention may also be used to form inserts having geometries other than that specifically described above and illustrated in FIG. 5.

FIG. 6 illustrates a rotary or roller cone drill bit in the form of a rock bit 84 comprising a number of the wear or cutting PCD inserts 76 disclosed above and illustrated in FIG. 5. The rock bit 84 comprises a body 86 having three legs 88 extending therefrom, and a roller cutter cone 90 mounted on a lower end of each leg. The inserts 76 are the same as those described above comprising the PCD body and materials of this invention, and are provided in the surfaces of each cutter cone 90 for bearing on a rock formation being drilled.

FIG. 7 illustrates the PCD insert described above and illustrated in FIG. 5 as used with a percussion or hammer bit 92. The hammer bit generally comprises a hollow steel body 94 having a threaded pin 96 on an end of the body for assembling the bit onto a drill string (not shown) for drilling oil wells and the like. A plurality of the inserts 76 are provided in the surface of a head 98 of the body 94 for bearing on the subterranean formation being drilled.

Figure 8:
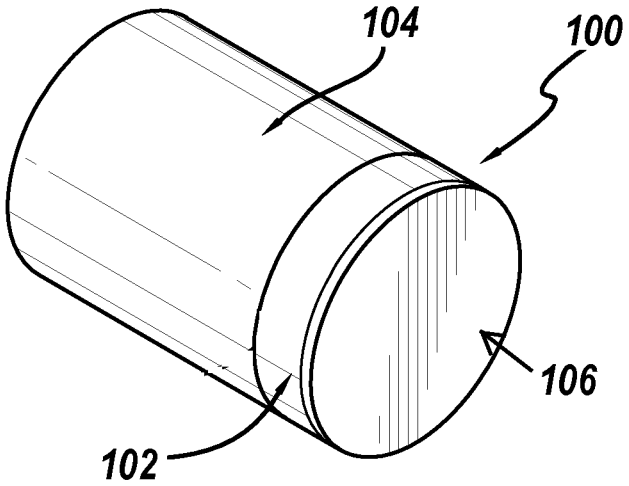
FIG. 8 is a perspective view of a PCD construction embodied in the form of a shear cutter.

FIG. 8 illustrates an example embodiment PCD construction of this invention as used to form a shear cutter 100 used, for example, with a drag bit for drilling subterranean formations. The PCD shear cutter 100 comprises a PCD body 102 that is sintered or otherwise attached to a cutter substrate 104 as described above. The PCD body 102 includes a working or cutting surface 106, and is formed in the manner described above. As discussed above, the working or cutting surface for the shear cutter may extend from the upper surface to an edge and/or beveled surface defining a circumferential edge of the upper surface. It is to be understood that PCD constructions of this invention may be used to form shear cutters having geometries other than that specifically described above and illustrated in FIG. 8.

Figure 9:
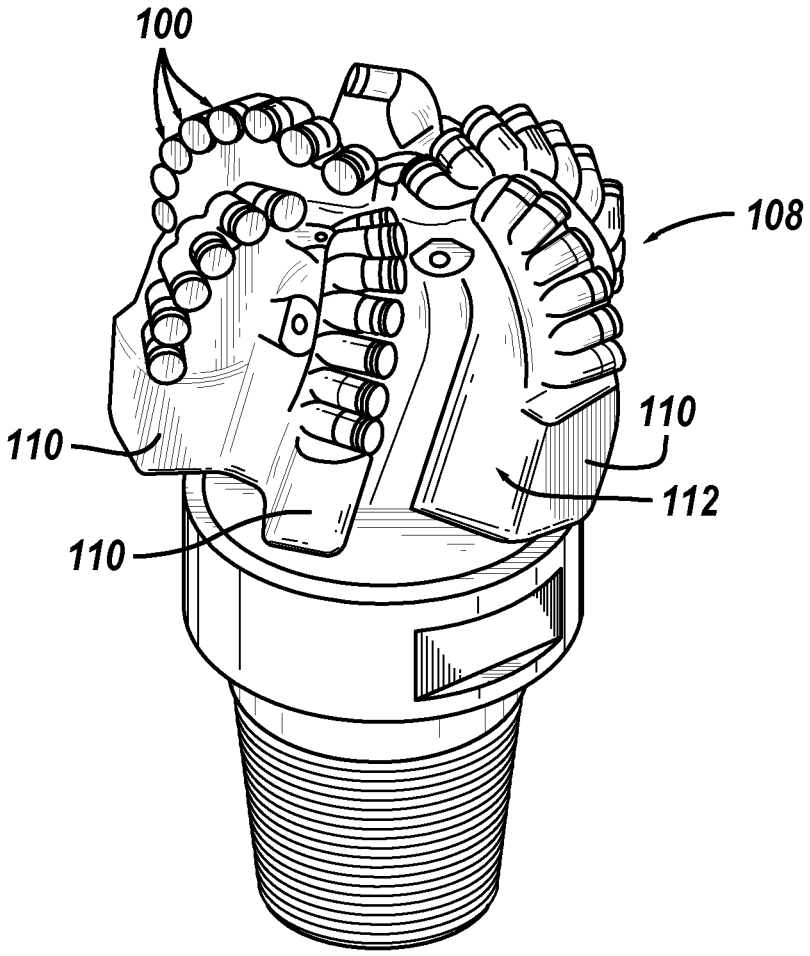
FIG. 9 is a perspective side view of a drag bit comprising a number of the shear cutters of FIG. 8.

FIG. 9 illustrates a drag bit 108 comprising a plurality of the PCD shear cutters 100 described above and illustrated in FIG. 8. The shear cutters are each attached to blades 110 that extend from a head 112 of the drag bit for cutting against the subterranean formation being drilled. Because the PCD shear cutters of this invention include a metallic substrate, they are attached to the blades by conventional method, such as by brazing or welding.

Other modifications and variations of PCD constructions methods for making the same according to the principles of this invention will be apparent to those skilled in the art. It is, therefore, to be understood that within the scope of the appended claims this invention may be practiced otherwise than as specifically described.

What is claimed:

1. A diamond bonded construction comprising a diamond body comprising a matrix phase of intercrystalline bonded-together diamond crystals and a plurality of interstitial regions dispersed among the bonded-together diamond crystals, the diamond body having a working surface at one location and an interface surface positioned at another location, the body having a diamond volume content with a gradient of greater than about 1.5 percent, the diamond body comprising a catalyst material and a material selected from the group consisting of carbides, nitrides, borides, oxides and combinations thereof disposed within the interstitial regions, and wherein the diamond body has a diamond volume content at the working surface of 98 percent or less according to one of the following criteria:

the diamond volume fraction is greater than (0.9077)·(the average diamond grain size $[\hat{}0.0221]^{0.0221}$); or the diamond volume fraction is greater than (0.9187)·(the average diamond grain size $[\hat{}0.0183]^{0.0183}$); or the diamond volume fraction is greater than (0.9291)·(the average diamond grain size $[\hat{}0.0148]^{0.0148}$), wherein the average diamond grain size is provided micrometers.

2. The diamond bonded construction as recited in claim 1 wherein the diamond volume content at the interface surface is less than 94 percent by volume and formed from diamond grains sized the same or greater than that at the working surface.

3. The diamond bonded construction as recited in claim 1 wherein the volume content of the catalyst material changes in a gradient manner within the body moving from the interface surface to the working surface.

4. The diamond bonded construction as recited in claim 3 wherein the volume content of the catalyst material increases moving from the working surface to the interface surface.

5. The diamond bonded construction as recited in claim 1 wherein the additional material is a carbide.

6. The diamond bonded construction as recited in claim 1 wherein the additional material has a volume content that changes moving from the working surface to the interface surface.

7. The diamond bonded construction as recited in claim 3 wherein the volume content of the catalyst material at the working surface is less than about 6 percent.

8. The diamond bonded construction as recited in claim 1 further comprising a substrate joined to the diamond body at the interface surface, wherein the substrate is selected from the group of materials consisting of ceramic materials, metallic materials, cermet materials, and combinations thereof.

9. The diamond bonded construction as recited in claim 1 wherein at least a portion of the diamond body is substantially free of a catalyst material used to form the body at high pressure-high temperature conditions.

10. The diamond bonded construction as recited in claim 9 wherein a partial region of the diamond body extending a depth from the working surface is substantially free of the catalyst material.

11. A bit for drilling subterranean formations comprising a number of cutting elements operatively attached to a bit body, wherein one or more of the cutting elements comprises the diamond bonded construction recited in claim 1.

12. A diamond bonded construction comprising a diamond body comprising a matrix phase of intercrystalline bonded-together diamond crystals and a plurality of interstitial regions dispersed among the bonded-together diamond crystals, the diamond body having a working surface at one location and an interface surface positioned at another location, the body having a diamond volume content with a gradient of greater than about 1.5 percent, the diamond body comprising a catalyst material and a material selected from the group consisting of carbides, nitrides, borides, oxides and combinations thereof disposed within the interstitial regions, and wherein the diamond body has a diamond volume content at the working surface according to one of the following criteria:

has a sintered average diamond grain size within the range of 2-4 microns, and a has diamond volume fraction greater than 93%; or has a sintered average grain size within the range of 4-6 microns, and has a diamond volume fraction greater than 94%; or has a sintered average grain size within the range of 6-8 microns, and has a diamond volume fraction greater than 95%; or has a sintered average grain size within the range of 8-10 microns, and a has diamond volume fraction greater than 95.5%; or has a sintered average grain size within the range of 10-12 microns, and has a diamond volume fraction greater than 96%.

13. The diamond bonded construction as recited in claim 12 wherein the volume content of the catalyst material changes in a gradient manner within the body moving from the interface surface to the working surface.

14. The diamond bonded construction as recited in claim 13 wherein the volume content of the catalyst material increases moving from the working surface to the interface surface.

15. The diamond bonded construction as recited in claim 12 wherein the additional material is a carbide.

16. The diamond bonded construction as recited in claim 1 wherein the additional material has a volume content that changes moving from the working surface to the interface surface.

17. The diamond bonded construction as recited in claim 12 wherein the volume content of the catalyst material at the working surface is less than about 6 percent.

18. The diamond bonded construction as recited in claim 12 further comprising a substrate joined to the diamond body at the interface surface, wherein the substrate is selected from the group of materials consisting of ceramic materials, metallic materials, cermet materials, and combinations thereof.

19. The diamond bonded construction as recited in claim 12 wherein at least a portion of the diamond body is substantially free of a catalyst material used to form the body at high pressure-high temperature conditions.

20. The diamond bonded construction as recited in claim 12 wherein a partial region of the diamond body extending a depth from the working surface is substantially free of the catalyst material.

21. A bit for drilling subterranean formations comprising a number of cutting elements operatively attached to a bit body, wherein one or more of the cutting elements comprises the diamond bonded construction recited in claim 12.

22. A diamond construction comprising:

a diamond body comprising a matrix phase of intercrystalline bonded diamond and a plurality of interstitial regions dispersed among the bonded diamond, the diamond body having a working surface at one location and an interface surface positioned at another location, a catalyst material and a carbide material disposed within the interstitial regions, wherein the volume content of both of the catalyst material and the carbide material changes in a gradient manner within the body moving from the interface surface to the working surface, and wherein the volume content of the catalyst material at the working surface is less than about 7 percent; and a substrate joined to the diamond body at the interface surface, wherein the substrate is selected from the group of materials consisting of ceramic materials, metallic materials, cermet materials, and combinations thereof.

23. The diamond construction as recited in claim 22 wherein the volume content of catalyst material increases moving from working surface to the interface surface.

24. The diamond construction material as recited in claim 22 wherein the volume of the carbide material within the diamond body increases moving from the interface surface to the working surface.

25. The diamond construction as recited in claim 22 wherein the volume of the carbide material within the diamond body is in the range of from about 1 to 10 percent.

26. The diamond construction as recited in claim 22 wherein the body has a diamond volume content with a gradient of greater than about 1.5 percent, and wherein the diamond grain size and diamond volume content at the working surface meets one of the following criteria:

has a sintered average diamond grain size within the range of 2-4 microns, and a has diamond volume fraction greater than 93%; or has a sintered average grain size within the range of 4-6 microns, and has a diamond volume fraction greater than 94%; or has a sintered average grain size within the range of 6-8 microns, and has a diamond volume fraction greater than 95%; or has a sintered average grain size within the range of 8-10 microns, and a has diamond volume fraction greater than 95.5%; or has a sintered average grain size within the range of 10-12 microns, and has a diamond volume fraction greater than 96%.

27. The diamond construction as recited in claim 22 wherein the body has a diamond volume content with a gradient of greater than about 1.5 percent and a diamond volume content of 98 percent or less, and wherein the diamond body has a diamond volume content at the working surface according to one of the following criteria:

the diamond volume fraction is greater than (0.9077)·(the average diamond grain size $[\hat{0.0221}]^{0.0221}$); or the diamond volume fraction is greater than (0.9187)·(the average diamond grain size $[\hat{0.0183}]^{0.0183}$); or the diamond volume fraction is greater than (0.9291)·(the average diamond grain size $[\hat{0.0148}]^{0.0148}$), wherein the average diamond grain size is provided micrometers.

28. The diamond construction as recited in claim 22 wherein the diamond volume content at the interface surface is less than 94 percent by volume and is formed from diamond grains sized the same or greater than that at the working surface.

29. The diamond construction as recited in claim 22 wherein the ratio of catalyst material to added carbide is balanced to promote optimum thermal stability within the diamond body.

30. The diamond construction as recited in claim 22 wherein the ratio of catalyst material to carbide within the diamond body is in the range of from about 6:1 to 1:10.

31. The diamond construction as recited in claim 22 wherein the ratio of catalyst material to carbide within the diamond body is in the range of from about 3:1 to 1:6.

32. The diamond construction as recited in claim 22 wherein the ratio of catalyst material to carbide at the working surface is in the range of from about 4:1 to 1:4.

33. A bit for drilling subterranean formations comprising a body and a plurality of cutting elements operatively attached to the body, wherein at least one of the cutting elements comprises the diamond construction as recited in claim 22.

34. A bit for drilling subterranean formations comprising:

a body; and a plurality of cutting elements operatively attached to the body, at least one cutting element comprising a polycrystalline diamond construction comprising:

a diamond body comprising a matrix phase of bonded together diamond crystals and a plurality of dispersed regions interstitially disposed within the matrix phase, the diamond body having a working surface at one location and an interface surface at another location, wherein a catalyst material and a carbide material is disposed within the interstitial regions and the volume content of the catalyst material decreases in a gradient manner within the body moving from the interface surface to the working surface, and wherein the volume content of the catalyst material at the working surface is less than about 6 percent; and a substrate joined to the diamond body at the interface surface, wherein the substrate is selected from the group of materials consisting of ceramic materials, metallic materials, cermet materials, and combinations thereof.

35. The bit as recited in claim 34 wherein the volume content of diamond changes within the body by greater than 1.5 percent.

36. The bit as recited in claim 34 wherein the volume content diamond changes within the body from 2 to 6 percent.

37. The bit as recited in claim 34 wherein the body has a diamond volume content with a gradient of greater than about 1.5 percent and a diamond volume content of 98 percent or less, and wherein the diamond body has a diamond volume content at the working surface according to one of the following criteria:

the diamond volume fraction is greater than (0.9077)·(the average diamond grain size [ˆ0.0221]$^{0.0221}$); or the diamond volume fraction is greater than (0.9187)·(the average diamond grain size [ˆ0.0183]$^{0.0183}$); or the diamond volume fraction is greater than (0.9291)·(the average diamond grain size [ˆ0.0148]$^{0.0148}$), wherein the average diamond grain size is provided micrometers.

38. The bit as recited in claim 34 wherein the diamond grain size and diamond volume content at the working surface meets one of the following criteria:

has a sintered average diamond grain size within the range of 2-4 microns, and a has diamond volume fraction greater than 93%; or has a sintered average grain size within the range of 4-6 microns, and has a diamond volume fraction greater than 94%; or has a sintered average grain size within the range of 6-8 microns, and has a diamond volume fraction greater than 95%; or has a sintered average grain size within the range of 8-10 microns, and a has diamond volume fraction greater than 95.5%; or has a sintered average grain size within the range of 10-12 microns, and has a diamond volume fraction greater than 96%.

39. The bit as recited in claim 34 wherein a region of the body adjacent the working surface is substantially free of the catalyst material.

40. The bit as recited in claim 34 comprising a number of blades projecting outwardly from the body, and wherein the cutting elements are attached to the blades.

41. The bit as recited in claim 34 comprising a number of legs extending outwardly from the body and cones rotatably disposed on the legs, wherein the cutting elements are attached to the cones.

* * * * *